US012383050B2

(12) United States Patent
Brennan

(10) Patent No.: US 12,383,050 B2
(45) Date of Patent: Aug. 12, 2025

(54) CLEANING TOOL HAVING SELECTIVELY DEPLOYABLE AUXILIARY CLEANING ELEMENT

(71) Applicant: Jesse D. Brennan, Brentwood, MO (US)

(72) Inventor: Jesse D. Brennan, Brentwood, MO (US)

( * ) Notice: Subject to any disclaimer, the term of this patent is extended or adjusted under 35 U.S.C. 154(b) by 278 days.

(21) Appl. No.: 17/982,539

(22) Filed: Nov. 8, 2022

(65) Prior Publication Data

US 2023/0180921 A1 Jun. 15, 2023

Related U.S. Application Data

(60) Provisional application No. 63/242,470, filed on Sep. 9, 2021.

(51) Int. Cl.

| | |
|---|---|
| ***A47L 13/12*** | (2006.01) |
| ***A46B 5/00*** | (2006.01) |
| ***A46B 5/02*** | (2006.01) |

(52) U.S. Cl.

CPC ..... *A46B 5/0008* (2013.01); *A46B 5/005* (2013.01); *A46B 5/0095* (2013.01); *A46B 5/02* (2013.01); *A47L 13/12* (2013.01); *A46B 2200/302* (2013.01)

(58) Field of Classification Search

CPC ..... A46B 5/0095; A46B 5/0008; A46B 5/005; A47L 13/12

See application file for complete search history.

(56) References Cited

U.S. PATENT DOCUMENTS

| | | | | |
|---|---|---|---|---|
| 8,533,890 | B2 * | 9/2013 | Pannell | A47L 13/022 16/427 |
| D699,412 | S | 2/2014 | Smith | |
| 9,085,078 | B1 | 7/2015 | Huang | |
| 9,386,842 | B2 | 7/2016 | Doherty | |
| D841,272 | S | 2/2019 | Libman | |
| 11,864,702 | B2 | 1/2024 | Bishop | |
| 2005/0132520 | A1 | 6/2005 | Navarro | |
| 2017/0172288 | A1 | 6/2017 | Bart | |
| 2019/0059212 | A1 * | 2/2019 | Njenga | A01D 11/06 |

FOREIGN PATENT DOCUMENTS

CN 210330503 U * 4/2020

* cited by examiner

*Primary Examiner* — Shay Karls
(74) *Attorney, Agent, or Firm* — David E. Crawford; Crawford I.P. Law

(57) ABSTRACT

A cleaning tool for cleaning a surface includes an elongated handle having a working end, a user end opposite the working end, and a hollow interior extending to the working end. The cleaning tool includes a principal cleaning head mounted on the working end of the handle. The tool includes an elongated shaft slidably received in the hollow interior of the handle. The elongated shaft has a top end positioned inside the hollow interior between the working end and the user end of the handle. The tool includes an auxiliary cleaning head mounted on the bottom end of the shaft. The shaft is selectively slidable relative to the handle to move the auxiliary cleaning head to a deployed position in which the auxiliary cleaning head extends farther from the handle than the principal cleaning head.

19 Claims, 6 Drawing Sheets

CLEANING TOOL HAVING SELECTIVELY DEPLOYABLE AUXILIARY CLEANING ELEMENT

CROSS-REFERENCE TO RELATED APPLICATION

The present application claims benefit to the extent permitted by law of U.S. Patent Application 63/242,470, filed on Sep. 9, 2021, which is hereby incorporated by reference in its entirety.

BACKGROUND

The present disclosure relates to a cleaning tool and more particularly to a cleaning tool having a selectively deployable auxiliary cleaning element to facilitate cleaning unobstructed surfaces, as well as less accessible areas.

Handheld cleaning tools, including long-handled cleaning tools generally consisting of an elongated handle having a cleaning head at one end, are well known. In the case of a broom, the cleaning head usually comprises a brush having bristles made of stiff materials such as natural grasses or synthetic fibers, and in the case of a mop, the cleaning head usually comprises an absorbent body made of materials such as sponge, thick yarn, or textile strips. Long-handled cleaning tools allow users to clean floors without stooping and reach surfaces farther than one armlength away. Although these tools work well for cleaning unobstructed surfaces, they are often more difficult to use in less accessible areas such as in corners, between narrowly spaced objects, and obstructed areas such as under or adjacent to obstacles. Other less accessible areas include more distant spaces like those found on higher walls and ceilings. To clean these less accessible areas, a user can continue cleaning with the more cumbersome and often less effective tool in hand or locate a more appropriate cleaning tool if available. Accordingly, different cleaning tools are needed to clean depending on the circumstances. To clean differing areas, a user will often have several cleaning tools. These additional tools come with additional cost and a user must carry them around or take time to retrieve them when circumstances dictate. Rather than either of these alternatives, users frequently leave less accessible areas uncleaned. In some cases, users opt for vacuum cleaners having extended tubes and smaller brushes to clean in a variety of situations, but vacuum cleaners are expensive and less portable compared to manual handheld cleaning tools and require a power source to operate. Thus, vacuum cleaners are less than optimal in some instances.

In view of the numerous drawbacks of available cleaning tools, it is apparent that there is a need for an improved alternative that overcomes the disadvantages inherent in current cleaning tools.

SUMMARY

In one aspect, a cleaning tool for cleaning a surface comprises an elongated handle having a working end, a user end opposite the working end, and a hollow interior extending to the working end. The cleaning tool also includes a principal cleaning head mounted on the working end of the handle. In addition, the tool comprises an elongated shaft slidably received in the hollow interior of the handle. The elongated shaft has a top end positioned inside the hollow interior between the working end and the user end of the handle. The tool further includes an auxiliary cleaning head mounted on the bottom end of the shaft. The shaft is selectively slidable relative to the handle to move the auxiliary cleaning head to a deployed position in which the auxiliary cleaning head extends farther from the handle than the principal cleaning head.

In another aspect, the disclosure includes a cleaning tool for cleaning a surface comprising an elongated handle having a user end and a working end opposite the user end. A principal cleaning head is mounted on the working end of the handle, and an elongated shaft is moveably attached to the handle. The shaft has a bottom end and a top end opposite the bottom end. In addition, the tool comprises an auxiliary cleaning head mounted on the bottom end of the shaft. The auxiliary cleaning head has a plurality of flexible cleaning elements. The auxiliary cleaning head is selectively moveable relative to the handle to a deployed position in which the auxiliary cleaning extends farther from the handle than the principal cleaning head and a retracted position in which the principal cleaning head extends farther from the handle than the auxiliary cleaning head.

In a further aspect, the present disclosure includes a broom for cleaning a surface comprising an elongated handle having a working end, a user end opposite the working end, and a hollow interior extending to the working end. A broom head is mounted on the handle. The broom head has an opening aligned with the handle and a plurality of fibers arranged in a bundle. The broom also comprises an elongated shaft slidably received in the hollow interior of the handle. The shaft extends through the opening in the broom head. Further, the broom comprises an auxiliary cleaning head mounted on the shaft. The shaft is selectively slidable relative to the handle to move the auxiliary cleaning head to a deployed position in which the auxiliary cleaning head extends farther from the handle than the broom head.

Other aspects of the present disclosure will be apparent in view of the following description and claims.

BRIEF DESCRIPTION OF DRAWINGS

Corresponding reference characters indicate corresponding parts throughout the drawings.

DETAILED DESCRIPTION OF DRAWINGS

Figure 1:
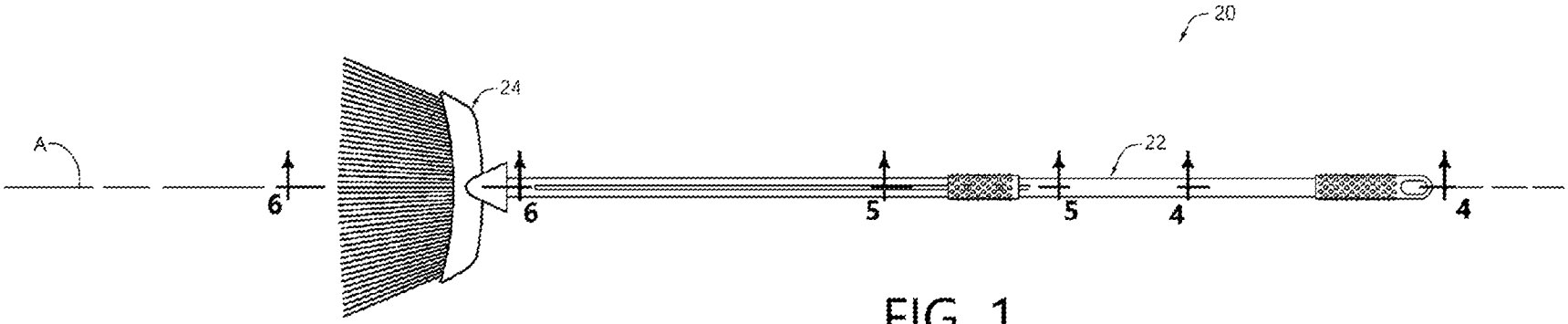
FIG. 1 is a schematic elevation of a cleaning tool having a selectively deployable auxiliary cleaning element in a retracted position as described herein.
Figure 2:
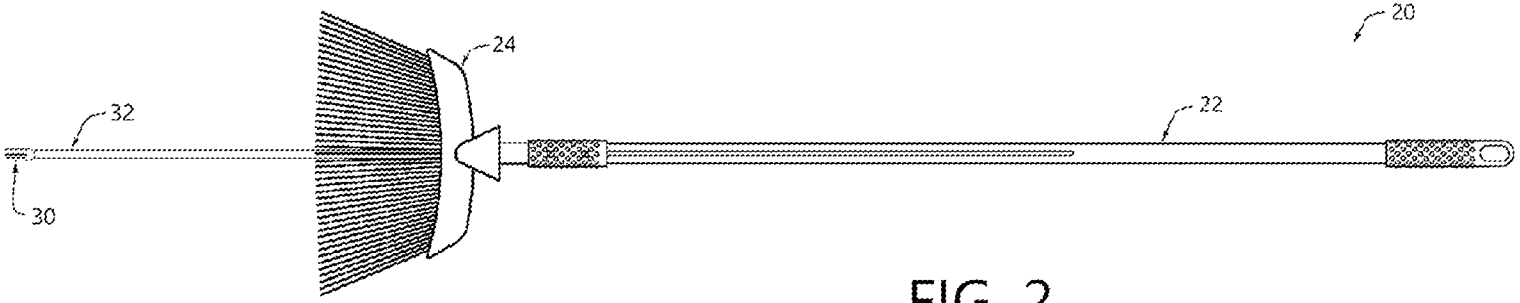
FIG. 2 is a schematic elevation similar to FIG. 1 showing the auxiliary cleaning element in a deployed position.

As shown in FIG. 1, a broom, or more broadly a cleaning tool, is designated in its entirety by the reference character 20. The broom 20 comprises an elongated handle, generally designated by 22, and a main or principal cleaning head, generally designated by 24. As shown in FIG. 2, the broom 20 also includes an auxiliary cleaning element, generally designated by 26, that generally comprises an auxiliary or supplemental cleaning head, generally designated by 30, mounted on an elongated rod or shaft, generally designated by 32. An unobstructed surface may be swept or cleaned using the principal cleaning head 24 as shown in FIG. 1. When a less accessible area is encountered, the user has an option to selectively deploy the auxiliary cleaning element 26 to expose the relatively smaller auxiliary cleaning head 30 as shown in FIG. 2 to brush, or more broadly clean, the less accessible area. Although the illustrated tool 20 is a broom, those skilled in the art will appreciate that other types of cleaning heads (e.g., mop heads or removable pads) are envisioned.

Figure 3:
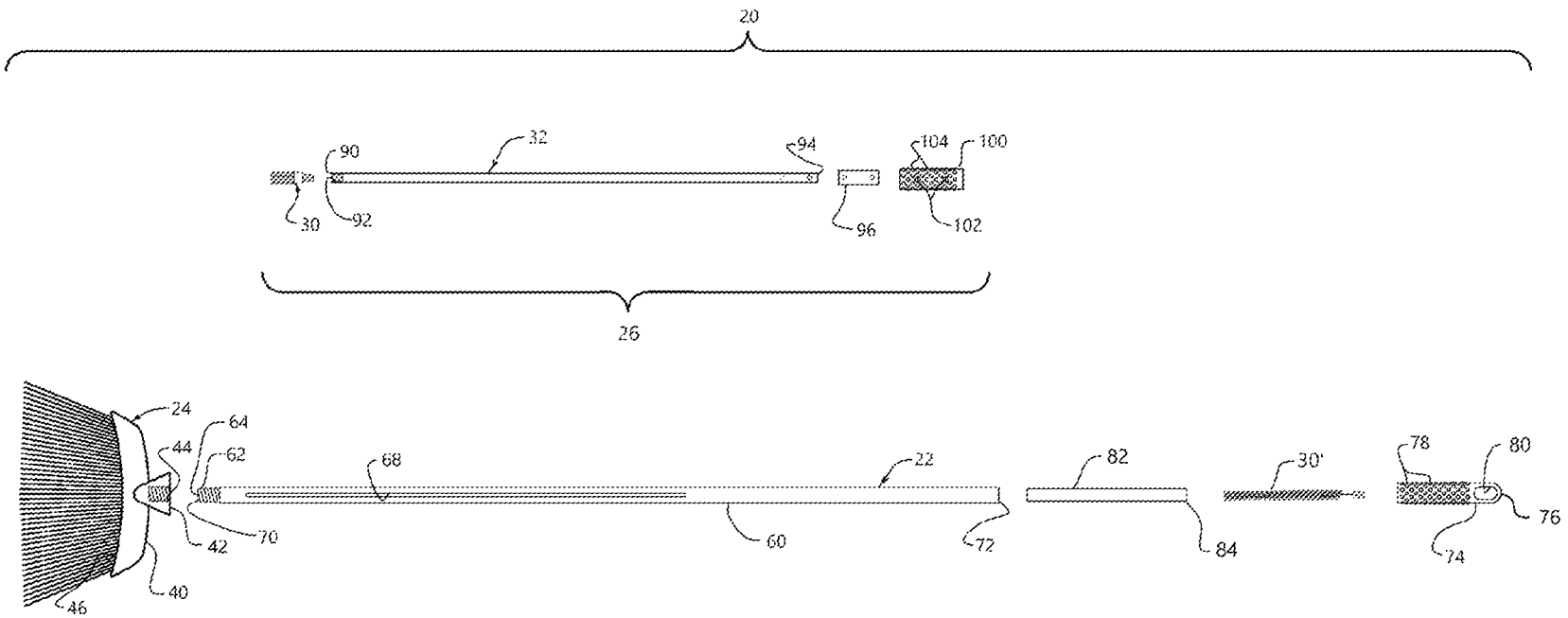
FIG. 3 is a separated schematic elevation of the cleaning tool of FIGS. 1 and 2.
Figure 4:
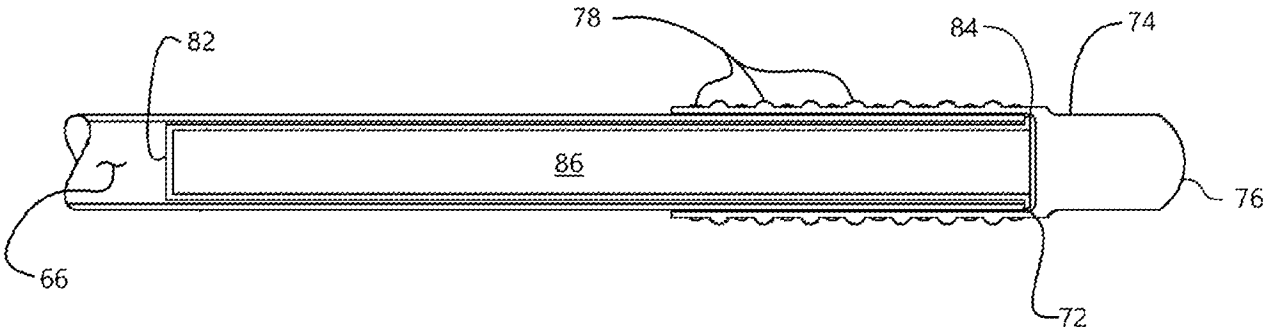
FIG. 4 is a cross section of the cleaning tool taken in the plane of line 5-5 of FIG. 1.

FIG. 3 illustrates a separated schematic elevation of the cleaning tool 20. The principal cleaning head 24 includes a body 40 having an upper face 42 on which a connector 44 (e.g., a threaded opening) is provided for connecting the head 24 to the handle 22. The body 40 also has a lower face 46 opposite the upper face 42. Bundles 48 consisting of a plurality of flexible synthetic fibers or bristles 50 are attached to the lower face 46 of the body 50 in the illustrated example. The fibers 50 extend downward from the body 50 to form a brush or broom head. Although the illustrated fibers 50 are extruded or drawn from a synthetic plastic or polymer, the fibers may be formed by other processes and other materials, including metal wires or grass. The body 40 is similar to many conventional broom heads except that it has a cylindrical opening 52 extending through the body from the upper face 42 to the lower face 46 as shown in FIG. 4. The opening 52 is axially aligned with the handle 22 and sized for slidably receiving the shaft 32. Although the illustrated body 40 is molded from a rigid plastic, bodies made from other materials and using different manufacturing processes are envisioned. As further shown in FIG. 3, the handle 22 comprises a hollow tube 60 having a connector 62 (e.g., an exterior screw thread) on a working end 64 of the handle. The connector 62 on the handle 22 is configured to engage the connector 44 on the body 40 to join the body and handle. It is envisioned that the handle 22 and principal head 24 may be joined permanently (e.g., using adhesives). Other conventional connectors are also contemplated. Although the hollow tube may be made of other materials and using other processes, the illustrated tube 60 is a thin-walled steel tube having a hollow interior 66 made by drawing. The illustrated tube 60 has an outer diameter of about one inch and a length of about 44 inches but other dimensions are envisioned. A slot 68 extends longitudinally along the tube 60 from about one inch above a lower end 70 adjacent to the working end 64 of the handle 22 toward an upper end 72 opposite the lower end. The illustrated slot 60 has a width of about 3/16 inch and a length of about 25 inches or half the handle length, but it is envisioned the slot may have other dimensions. A cap 74 fitted over the upper end 72 of the handle 22 forms a user end 76 of the handle. The cap 74 in the illustrated example includes a plurality of protrusions 78 to prevent the cap from slipping in a user's hand but may have other surface treatments and textures for preventing slipping. The cap 74 also includes a hole 80 for hanging the tool 20 when not in use so the tool need not be rested on the fibers 50. In some examples, the cap 74 is tightly fitted on the handle 22 to prevent it from being removed.

As shown in FIGS. 3 and 4, an optional tubular insert 82 is inserted into the upper end 72 of the tube 60 so a flange 84 on the insert engages the upper end of the tube. When tool 20 includes the tubular insert 82, the cap 74 is selectively removable to expose a compartment 86 inside the insert. The compartment 86 provides a convenient storage space for an alternative auxiliary head such as a duster head, generally designated by 30', as shown. A user may selectively replace the auxiliary cleaning head 30 mounted on the shaft 32 with the alternative duster head 30' to optimize cleaning in some circumstances. Alternative auxiliary cleaning heads (e.g., 30 and 84) make the tool 20 optimally suited for a wider variety of cleaning circumstances.

Figure 5:
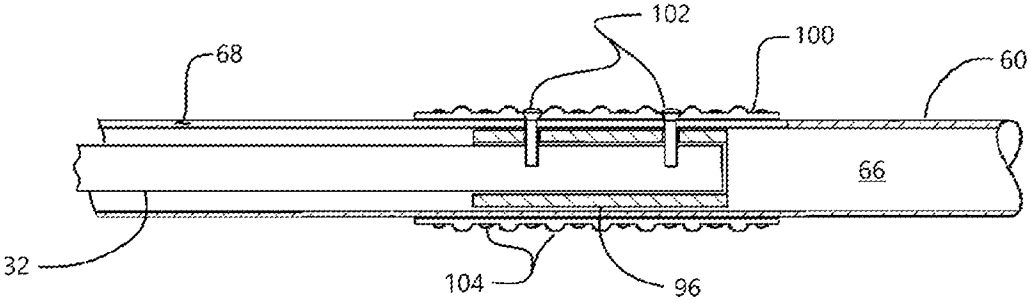
FIG. 5 is a cross section of the cleaning tool taken in the plane of line 6-6 of FIG. 1.
Figure 6:
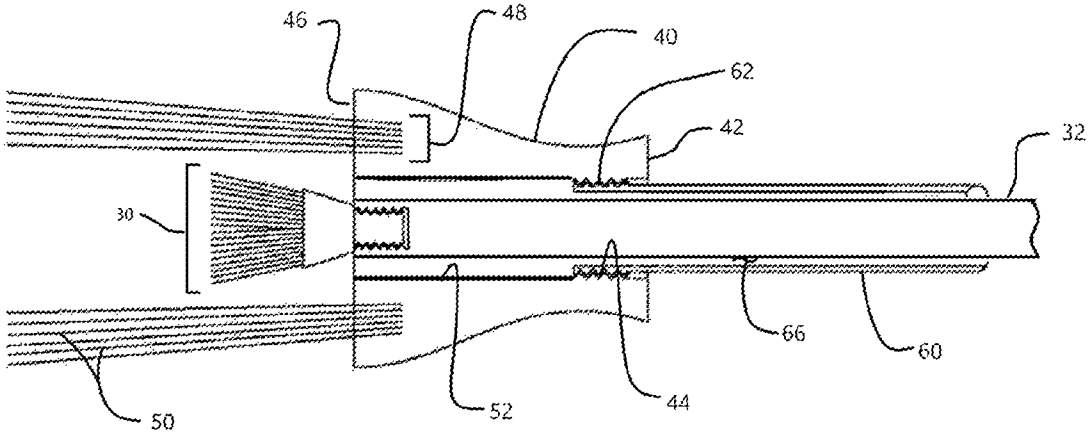
FIG. 6 is a cross section of the cleaning tool taken in the plane of line 7-7 of FIG. 1.

As illustrated in FIGS. 5 and 6, the shaft 32 is slidably received in the hollow interior 66 of the tube 60. The shaft 32 extends from a bottom end 90 having a connector 92 (e.g., an external thread) to a top end 94. A spacer 96 fits over the top end 94 of the shaft 32 to center and guide the shaft in the hollow interior 66 of the tube 60. A tubular grip 100 is slidably positioned around the tube 60 and is fastened to the spacer 96 with fasteners 102 (e.g., screw fasteners). The fasteners 102 are angularly aligned with the slot 68 so they extend through the slot when connecting the grip 100, the spacer 96, and the tube 60. The grip 100 in the illustrated example includes a plurality of protrusions 104 to prevent the grip from slipping in a user's hand but other surface treatments and textures may be used to prevent slipping. When a user slides the grip 100 along the tube 60, the fasteners 102 slide along slot 68, moving the spacer 96 and shaft 32 inside the hollow interior 66 of the tube. When the user slides the grip 100 toward the lower end 70 of the tube 60, the shaft 32 pushes the auxiliary head 30 downward past the fibers 50 of the principal cleaning head 20 for use in cleaning less accessible areas. When the auxiliary head 30 is no longer needed, the user slides the grip toward the upper end 72 of the tube, the shaft 32 pulls the auxiliary head upward between the fibers 50 so the principal cleaning head 20 extends farther from the handle 22 than the auxiliary head 30 to allow the principal head to be used freely. Additionally, sleeves (not shown) may be inserted over the fasteners 102 inside the slot 68 to enhance smooth operation and prevent the fasteners from hanging up in the slot 68. As further illustrated in in FIG. 6, the auxiliary cleaning head 30 includes a hub 110 having a connector 112 configured to releasably connect the head to the connector 92 on the bottom end 90 of the shaft. Although the illustrated connectors 92, 112 are screw connectors, other conventional connectors including detent and bayonet connectors are envisioned for connecting the head 30 to the shaft 32. Further, in some examples, the connectors may be eliminated and the hub 110 and shaft 32 may be unitarily formed as one piece. Of course, in these examples other auxiliary cleaning heads cannot be substituted for the unitary cleaning head. The illustrated shaft 32 and hub 110 are formed from a suitable polymer but other materials including metals and composite materials such as fiberglass and carbon reinforced epoxies are envisioned. Further, it is envisioned that the shaft 32 may be solid or tubular. Although the illustrated grip 100 is molded from a suitable polymer, other materials and manufacturing processes are envisioned.

Figure 7A:
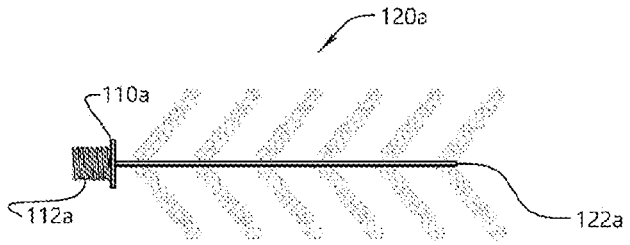
FIG. 7A-7C are schematic elevations of alternative auxiliary heads for the auxiliary cleaning element.
Figure 7B:
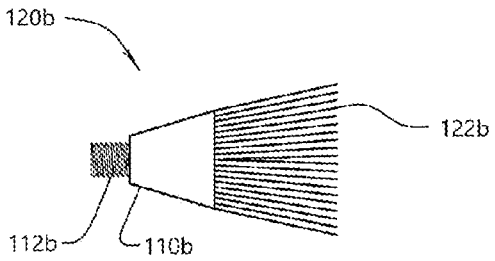
Figure 7C:
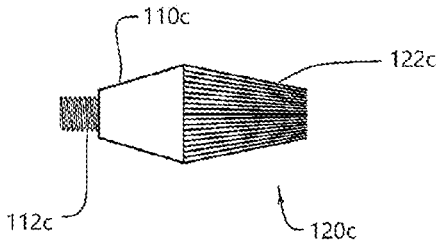

The head 30 illustrated in FIG. 6 includes a plurality of flexible elements 114 (e.g., fibers) arranged as a flat brush. As shown in FIGS. 7A-7C, alternative auxiliary cleaning heads 120*a*-120*c* are envisioned. These heads 120*a*-120*c* may be optionally provided with the tool 20 described above to offer a variety of cleaning head solutions. Each head 120*a*-120*c* includes a hub 110*a*-110*c* having a connector 112*a*-112*c* adapted to connect to the connector 92 on the shaft 32 so they may be selectively used in place of the installed head (e.g., head 30) to optimize cleaning. As shown in FIG. 7A, the head 120*a* may include a shammy or feather duster, generally designated by 122, attached to the hub 110*a*. As shown in FIG. 7B, the head 120*b* may include a plurality of elements arranged as an outward fanning conical brush, generally designated by 124, or as shown in FIG. 7C, the head 120*c* may include a plurality of elements arranged in an inwardly fanning pattern. As will be appreciated, the auxiliary cleaning heads may be made in most any conventional style from conventional materials and using conventional technique. Accordingly, alternative cleaning head designs may include various bristle orientations and shapes, duster attachments, blind cleaning attachments, scrubbing attachments, and disposable cleaning pads.

As suggested above, the principal cleaning head 22 of the cleaning tool 20 may be used to clean (e.g., sweep) an open floor. When an obstacle is encountered that prevents the principal head 22 from reaching an area, the user slides the grip 100 down the handle 24 extending the auxiliary cleaning head 32 farther from the handle than the principal cleaning 22 head so the auxiliary cleaning head may be used. One example of an obstacle might be a steam radiator. The smaller auxiliary cleaning head might be used to clean under or behind the radiator. An example of less accessible area might be in a corner of a high ceiling. The deployed auxiliary cleaning head might be used to reach a cobweb in the corner.

As various changes could be made to the constructions and methods described herein, it is intended that all matter contained in the above description or shown in the accompanying drawings shall be interpreted as illustrative and not in a limiting sense. The patentable scope of the disclosure is defined by the claims, and can include other constructions and methods that would occur to those skilled in the art. Such other constructions are intended to be within the scope of the claims if the structural elements of the constructions do not differ from the literal language of the claims, or if the constructions include equivalent structural elements having insubstantial differences from the literal languages of the claims.

To the extent that the specification, including the claims and accompanying drawing, discloses any additional subject matter that is not within the scope of the claims below, the disclosures are not dedicated to the public and the right to file one or more applications to claims such additional disclosures is reserved.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

The invention claimed is:

1. A cleaning tool for cleaning a surface, comprising:

an elongated handle having a working end, a user end opposite the working end, a hollow interior extending to the working end, and a slot extending into the hollow interior and longitudinally along the elongated handle;

a principal cleaning head mounted on the working end of the handle;

an elongated shaft slidably received in the hollow interior of the handle and having a top end positioned inside the hollow interior between the working end and the user end of the handle;

a tubular grip extending between opposite end openings, the grip surrounding the handle and being selectively slidable along the handle between the user end and the working end;

a connector passing through the slot connecting the grip to the shaft; and an auxiliary cleaning head mounted on the bottom end of the shaft;

wherein the connector moves along the slot as the grip slides along the handle toward the working end so the shaft moves inside the hollow interior of the handle to move the auxiliary cleaning head to a deployed position in which the auxiliary cleaning head extends farther from the handle than the principal cleaning head; and wherein the connector moves along the slot as the grip slides along the handle toward the user end so the shaft moves inside the hollow interior of the handle to move the auxiliary cleaning head to a retracted position in which the auxiliary cleaning head is withdrawn into the principal cleaning head.

2. A cleaning tool as set forth in claim 1, wherein:

said auxiliary cleaning head is a first auxiliary cleaning head; and the tool further comprises a second auxiliary cleaning head that is selectively mountable on the shaft.

3. A cleaning tool as set forth in claim 2, wherein:

said first auxiliary cleaning head is selectively detachable from the bottom end of the shaft; and said second auxiliary cleaning head is selectively mountable on the bottom end of the shaft when the first auxiliary cleaning head is detached from the bottom end of the shaft.

4. A cleaning tool as set forth in claim 3, wherein the shaft includes a threaded connector for selectively detaching the first cleaning head from the bottom end of the shaft and selectively mounting the second auxiliary cleaning head to the bottom end of the shaft.

5. A cleaning tool as set forth in claim 1, wherein the shaft is selectively slidable relative to the handle to move the auxiliary cleaning head to a retracted position in which the principal cleaning head extends farther from the handle than the auxiliary cleaning head.

6. A cleaning tool as set forth in claim 1, wherein the principal cleaning head comprises a bundle including a plurality of flexible fibers.

7. A cleaning tool as set forth in claim 1, wherein the auxiliary cleaning head comprises a plurality of flexible cleaning elements.

8. A cleaning tool for cleaning a surface, comprising:

an elongated handle having a user end and a working end opposite the user end;

a principal cleaning head mounted on the working end of the handle;

an elongated shaft moveably attached to the handle, said shaft having a bottom end and a top end opposite the bottom end;

a first auxiliary cleaning head selectively mountable on the bottom end of the shaft, said first auxiliary cleaning head having a plurality of flexible cleaning elements;

a second auxiliary cleaning head selectively mountable on the bottom end of the shaft when the first auxiliary cleaning head is detached from the bottom of the shaft; and a compartment positioned in the handle between the user end and the shaft sized for receiving at least one head selected from said first auxiliary cleaning head and said second auxiliary cleaning head when detached from the bottom of the shaft to store said at least one head;

wherein said first auxiliary cleaning head when mounted on the bottom end of the shaft is selectively moveable relative to the handle to a deployed position in which said first auxiliary cleaning extends farther from the handle than the principal cleaning head and a retracted position in which the principal cleaning head extends farther from the handle than said first auxiliary cleaning head;

wherein said second auxiliary cleaning head when mounted on the bottom end of the shaft is selectively moveable relative to the handle to a deployed position in which said second auxiliary cleaning extends farther from the handle than the principal cleaning head and a retracted position in which the principal cleaning head extends farther from the handle than said second auxiliary cleaning head; and wherein said at least one head when selectively detached from the bottom of the shaft is selectively storable in the compartment positioned in the handle.

9. A cleaning tool as set forth in claim 8, wherein the elongated shaft is slidably attached to the handle.

10. A cleaning tool as set forth in claim 9, wherein:

the handle has a hollow interior extending to the working end of the elongated handle;

the principal cleaning head has an opening aligned with the working end of the handle;

the top end of the shaft is positioned inside the hollow interior of the handle; and the shaft extends through the opening in the principal cleaning head.

11. A cleaning tool as set forth in claim 8, wherein the tool further comprises a plurality of auxiliary cleaning heads including said first auxiliary cleaning head and said second auxiliary cleaning head.

12. A cleaning tool as set forth in claim 11, wherein each auxiliary cleaning head of said plurality of auxiliary cleaning heads is selectively mountable on the bottom end of the shaft.

13. A cleaning tool as set forth in claim 8, wherein the principal cleaning head comprises a bundle including a plurality of fibers.

14. A cleaning tool as set forth in claim 8, wherein said second auxiliary cleaning head comprises a plurality of flexible cleaning elements.

15. A cleaning tool as set forth in claim 14, wherein said second auxiliary cleaning head comprises a plurality of flexible cleaning elements arranged as a flat brush.

16. A cleaning tool as set forth in claim 14, wherein said second auxiliary cleaning head comprises a plurality of flexible cleaning elements arranged as an outward fanning conical brush.

17. A cleaning tool as set forth in claim 14, wherein said second auxiliary cleaning head comprises a plurality of flexible cleaning elements arranged as an inwardly fanning pattern.

18. A cleaning tool as set forth in claim 8, further comprising a cap fitted over the user end of the handle, said cap being selectively removable to expose the compartment.

19. A broom for cleaning a surface, comprising:

an elongated handle having a working end, a user end opposite the working end, and a hollow interior extending to the working end;

a broom head mounted on the handle and having an opening aligned with the handle and a plurality of fibers arranged in a bundle;

an elongated shaft slidably received in the hollow interior of the handle and extending through the opening in the broom head;

an auxiliary cleaning head mounted on the shaft; and a tubular grip having opposite end openings sized for receiving the handle between the user end and the working end, the grip being operatively connected to the shaft and selectively slidable along the handle so that when the grip slides along the handle toward the working end the shaft slides relative to the handle to move the auxiliary cleaning head to a deployed position in which the auxiliary cleaning head extends farther from the handle than the broom head and when the grip slides along the handle toward the user end the shaft slides relative to the handle to move the auxiliary cleaning head to a retracted position in which the broom head extends farther from the handle than the auxiliary cleaning head.

* * * * *